US005673828A

United States Patent [19]

Raedel et al.

[11] Patent Number: 5,673,828

[45] Date of Patent: Oct. 7, 1997

[54] INFANT CARRIER WITH MULTI-FUNCTIONAL CYLINDRICALLY SHAPED SEAT STRUCTURE

[75] Inventors: Holly Raedel, Olympia, Wash.; Tami Majewski, Santa Maria, Calif.

[73] Assignee: Baby Packer's L.L.C., Olympia, Wash.

[21] Appl. No.: 544,001

[22] Filed: Oct. 17, 1995

[51] Int. Cl.[6] ..... A61G 1/013

[52] U.S. Cl. ..... 224/160; 224/158

[58] Field of Search ..... 224/158, 159, 224/160, 161, 148.4, 638, 148.5

[56] References Cited

U.S. PATENT DOCUMENTS

| | | | |
|---|---|---|---|
| 3,575,326 | 4/1971 | Chappell | 224/159 |
| 4,068,786 | 1/1978 | Ianiguchi | 224/159 |
| 4,149,687 | 4/1979 | Nunemacher | 224/159 |
| 4,487,346 | 12/1984 | Fischer, Jr. . | |
| 4,492,326 | 1/1985 | Storm . | |
| 4,901,898 | 2/1990 | Colombo et al. . | |
| 4,941,604 | 7/1990 | Nagareda . | |
| 5,114,059 | 5/1992 | Thatcher | 224/148.5 |
| 5,224,637 | 7/1993 | Colombo . | |
| 5,292,042 | 3/1994 | Yamaguchi et al. | 224/159 |

*Primary Examiner*—Henry J. Recla
*Assistant Examiner*—Charles R. Eloshway
*Attorney, Agent, or Firm*—Majestic, Parsons, Siebert & Hsue

[57] ABSTRACT

An infant carrier includes a flexible front pad for securing the torso of an infant against the body of a person wearing the infant carrier, a substantially rigid cylindrical seat structure connected to the front pad by a center strap for supporting the seat of the infant, and a back pad attachable to the front pad and seat structure through shoulder, chest, and waist straps. The back pad is placed against either the chest or back of the person wearing the infant carrier, and the front pad and seat structure are placed adjacent to the back pad with the infant installed. The shoulder and chest straps are then adjusted and fastened to the front pad, and the waist straps adjusted and fastened to the seat structure so as to securely hold the infant against the person wearing the infant carrier while distributing the weight of the infant between the shoulders, chest, and waist of the person wearing the infant carrier.

18 Claims, 5 Drawing Sheets

INFANT CARRIER WITH MULTI-FUNCTIONAL CYLINDRICALLY SHAPED SEAT STRUCTURE

BACKGROUND OF THE INVENTION

This invention relates in general to infant carriers and in particular, to a front or back mountable infant carrier with a multi-functional seat structure.

U.S. Pat. No. 4,492,326 issued to Linda W. Storm, which is incorporated herein by this reference, describes a sling-type infant carrier, wherein an infant generally "hangs" uncomfortably at his or her crotch from a strap or cloth diaper, and her or his arms and legs are generally uncomfortably constrained from moving freely. Further, the weight of the infant is uncomfortably borne primarily on the shoulders of a person wearing the infant carrier, thereby inducing neck and shoulder strain.

U.S. Pat. No. 4,487,346 issued Bernhardt B. Fischer, Jr., which is incorporated herein by this reference, describes another sling-type infant carrier, wherein an infant also generally "hangs" uncomfortably at his or her crotch from a strap or cloth diaper, and at least one of her or his arms and legs are also uncomfortably constrained from moving freely. Although the infant is slung to the side of a wearer, the weight of the infant is uncomfortably borne primarily on the opposite shoulder of the wearer.

U.S. Pat. No. 5,224,637 issued to Margaret A. Colombo, which is incorporated herein by this reference, describes a waist-mounted infant carrier, wherein an infant sits on a seat structure integrated onto a belt worn around the waist of a wearer. Although the infant sits comfortably on the seat structure, and the weight of the infant is borne primarily at the waist or hip of the wearer, the carrier lacks straps to secure the infant against the body of the wearer, thus requiring the wearer to constantly hold the infant, thereby causing eventual arm fatigue and/or possibly "dropping" the infant.

U.S. Pat. No. 4,941,604 issued to Neil N. Nagareda, which is incorporated herein by this reference, describes a front pack infant carrier, wherein an infant sits on a padded rectangular seat of flexible material and is secured against the body of a wearer by a thin horizontal waist strap. The weight of the infant is borne primarily by the shoulders of a person wearing the infant carrier.

Although numerous approaches have been taken to the design and construction of infant carriers, such designs are still worthy of improvement as to securely holding an infant in place with minimum confinement in such a way as to be comfortable for both the infant as well as the wearer of the infant carrier over an extended period of time.

OBJECTS AND SUMMARY OF THE INVENTION

Accordingly, one object of the present invention is an infant carrier that comfortably seats an infant being carried.

Another object is an infant carrier that does not constrain movement of the arms and legs of an infant being carried;

Yet another object is an infant carrier that is comfortably worn by a person wearing the infant carrier.

Still another object is an infant carrier that is sturdy, economical, and multi-functional.

These and additional objects are accomplished by the various aspects of the present invention, wherein briefly stated, one aspect is an infant carrier having a substantially rigid seat structure (e.g., 104) upon which the infant comfortably sits while being carried in the infant carrier. The seat structure facilitates free movement without constraint of the infant's arms and legs, to the delight of the infant.

Preferably, the infant carrier also has a front pad (e.g., 102) connected to the seat structure by a center strap (e.g., 106), and a back pad (e.g., 202) connectable to the front pad and seat structure through adjustable chest (e.g., 204), waist (e.g., 206), and shoulder (e.g., 208 and 210) straps which facilitate comfortable distribution of the infant's weight between the chest, waist, and shoulders of a person wearing the infant carrier. Preferably, the seat structure comprises a hollow cylinder which is thermally insulated, padded, and covered with fabric. Preferably, one end of the covered cylinder is zippered (e.g., 124) so that items such as a baby bottle can be securely stored in its cavity (e.g., 134). A pocket and/or bottom compartment (e.g., 126) is also formed with the fabric to store flat items such as diapers.

Another aspect is an infant carrier comprising a first structure including a front pad, a seat structure, and a center strap connecting the front pad to the seat structure; and a second structure including a back pad having adjustable right and left shoulder straps, an adjustable chest strap, and an adjustable waist strap, wherein the adjustable right and left shoulder straps and the adjustable chest strap are connected by means for fastening the adjustable right and left shoulder straps and the adjustable chest strap to the front pad of the first structure, and the adjustable waist strap to the seat structure of the first structure, such that the weight of an infant being carried in the infant carrier is distributed between the shoulders, chest, and waist of a person wearing the infant carrier.

Another aspect is an infant carrier comprising a front pad; a substantially rigid seat structure connected to the front pad; a back pad having adjustable shoulder straps, an adjustable chest strap, and an adjustable waist strap; and means for fastening the adjustable shoulder straps and adjustable chest straps to the front pad, and the adjustable waist strap to the substantially rigid seat structure such that the weight of an infant sitting on the substantially rigid seat structure is comfortably distributed between the shoulders, chest, and waist of a person wearing the infant carrier.

Additional objects, features and advantages of the various aspects of the present invention will become apparent from the following description of its preferred embodiment, which description should be taken in conjunction with the accompanying drawings.

DETAILED DESCRIPTION OF THE PREFERRED EMBODIMENT

The preferred embodiment of an infant carrier utilizing aspects of the present invention, is best understood by referring to the figures, wherein like reference numbers are used to indicate like and corresponding parts of the drawings.

Figure 1:
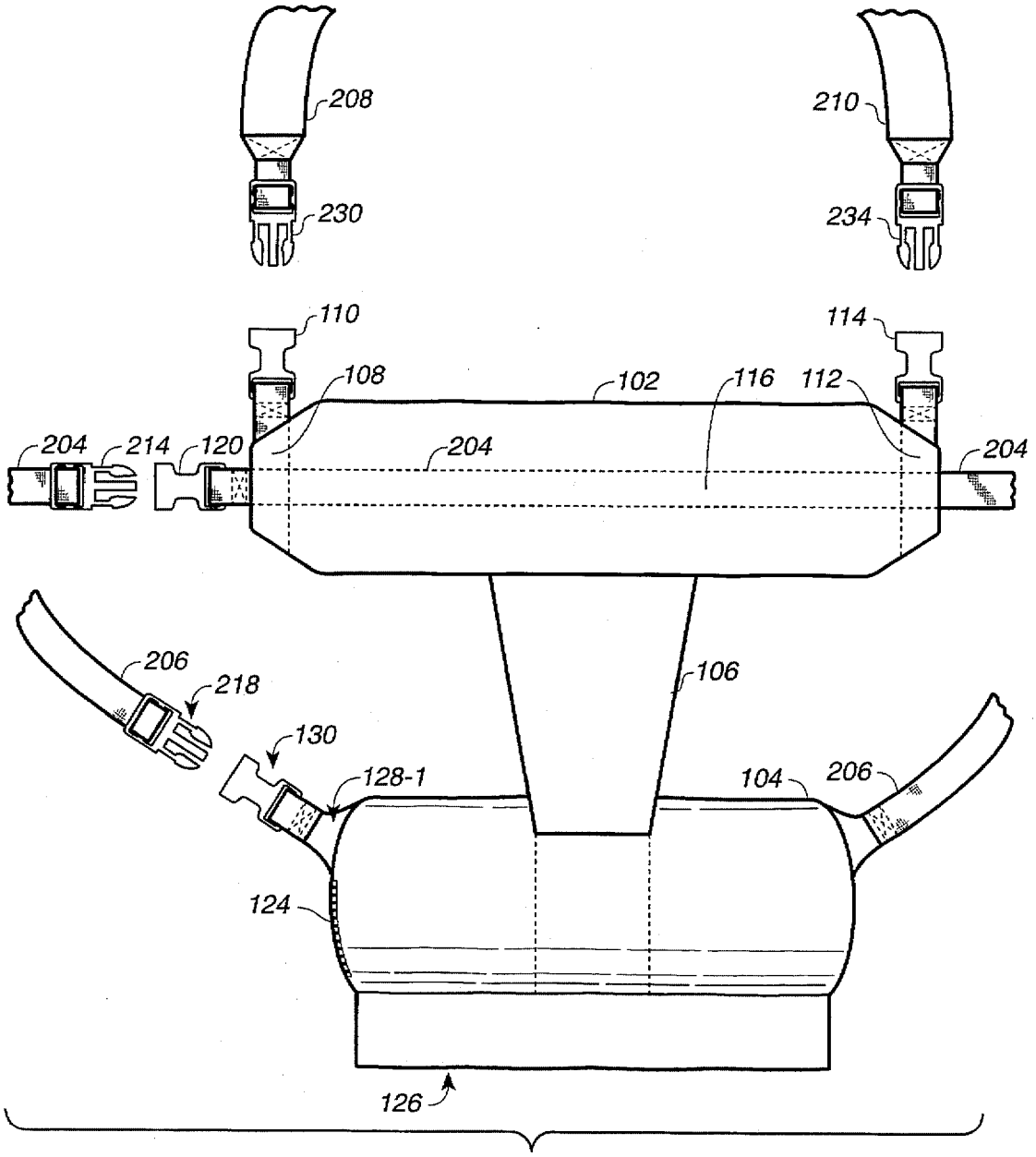
FIG. 1 illustrates, as an example, a front elevational view of a first half of an infant carrier utilizing aspects of the present invention.
Figure 2:
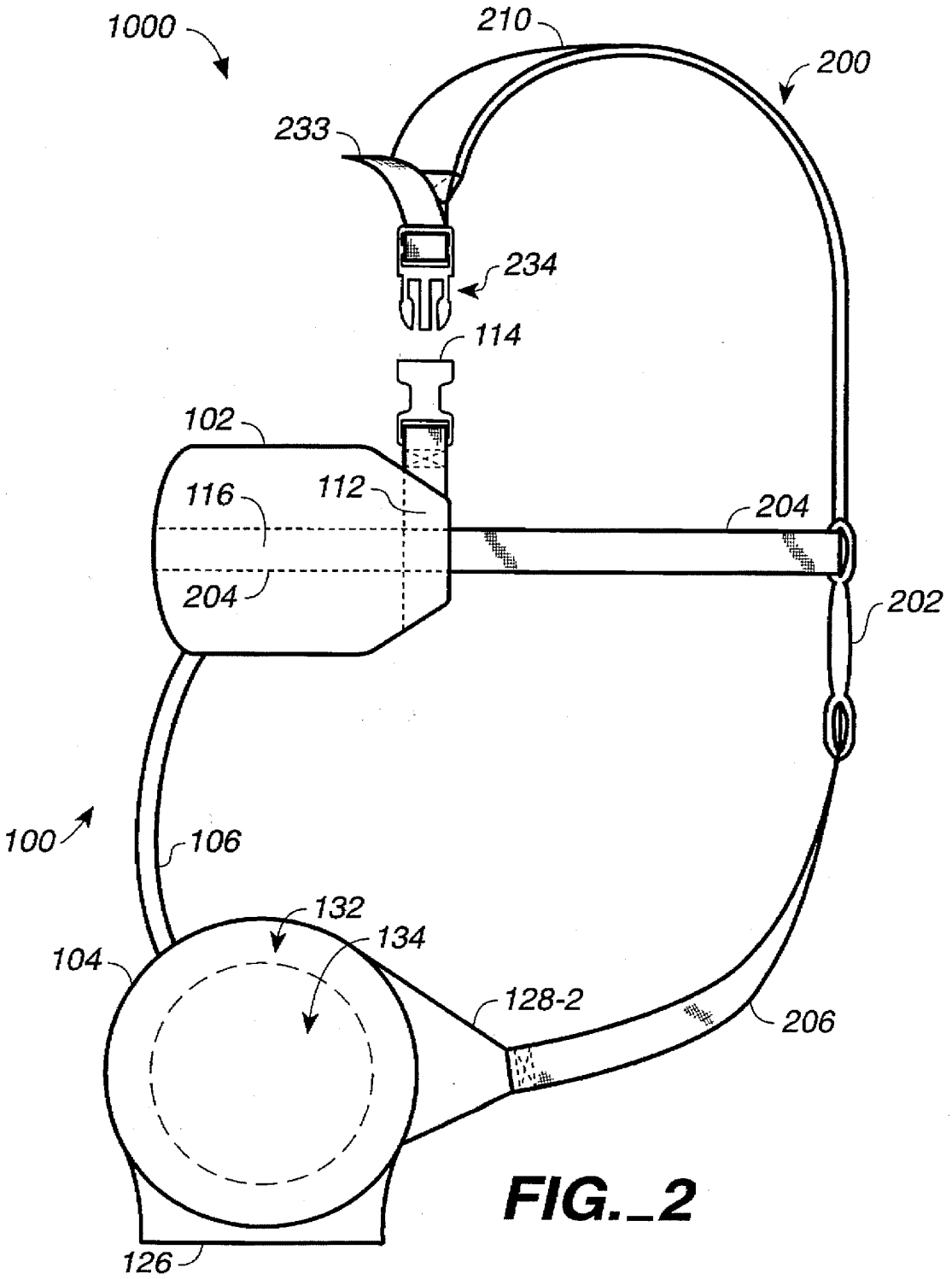
FIGS. 2 and 3 respectively illustrate, as examples, left and right side elevational views of the first and a second half of the infant carrier utilizing aspects of the present invention.
Figure 3:
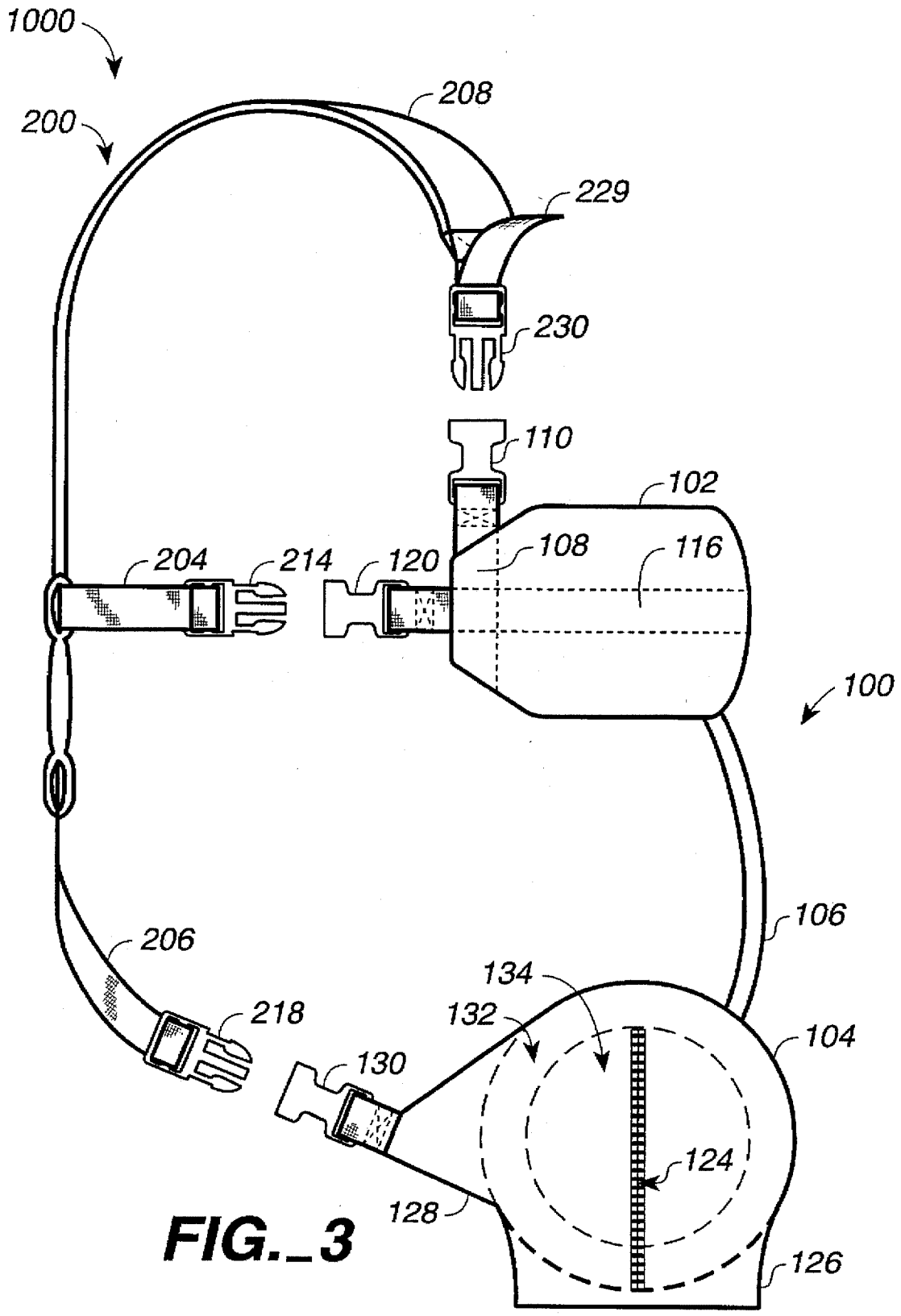
Figure 4:
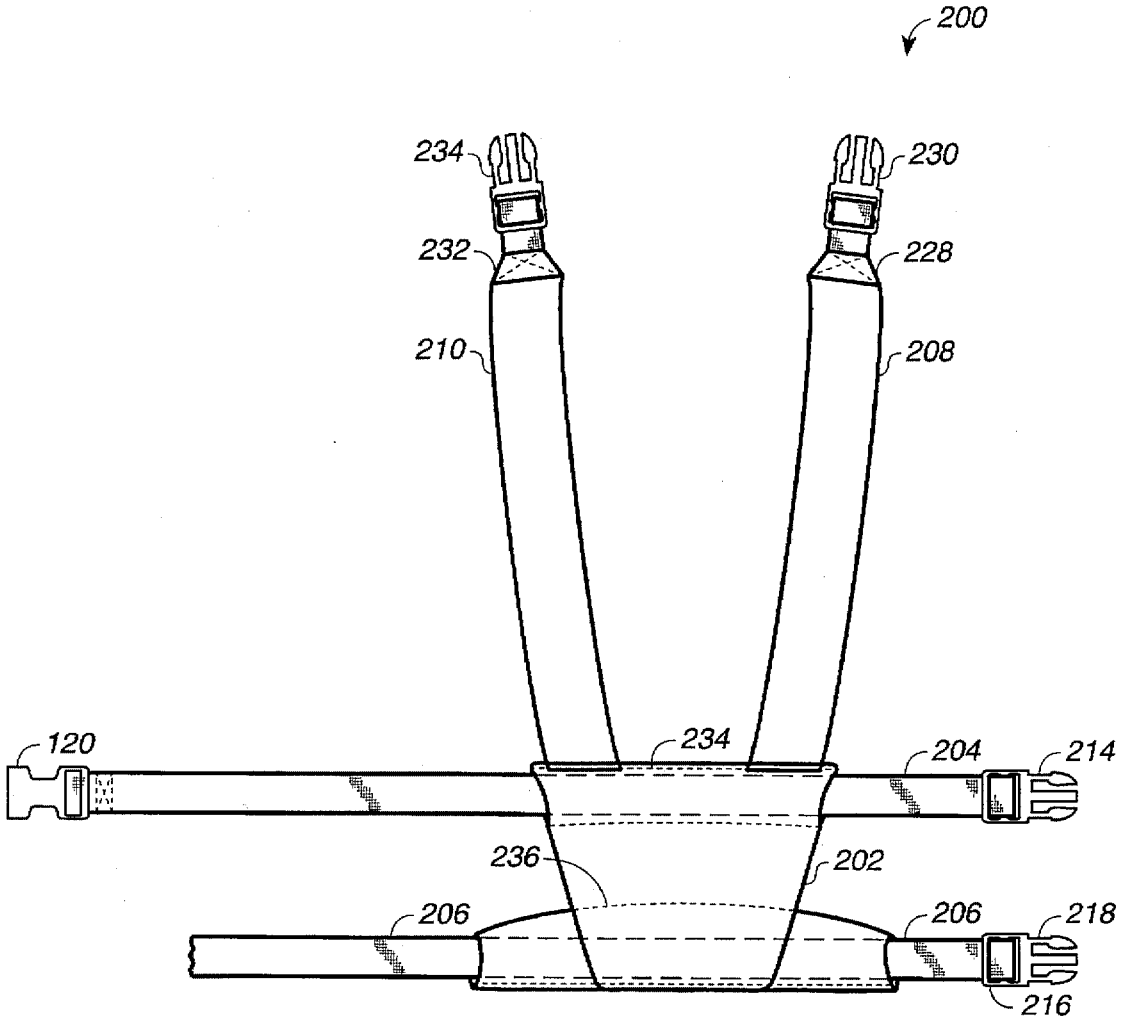
FIG. 4 illustrates, as an example, a back elevational view of the second half of the infant carrier utilizing aspects of the present invention.
Figure 5:
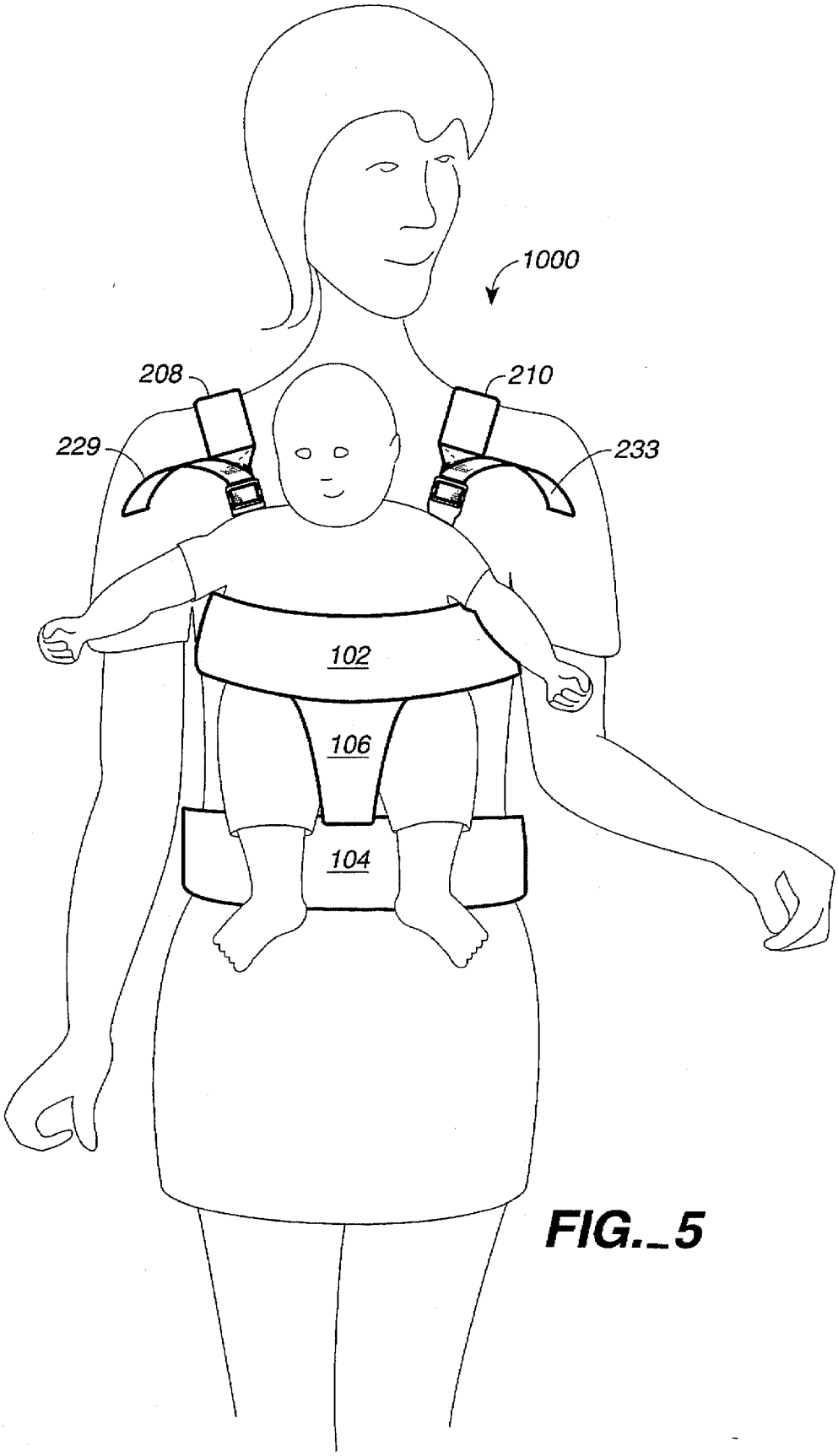
FIG. 5 illustrates, as an example, a typical employment of the infant carrier utilizing aspects of the present invention.

In particular, the preferred embodiment of the infant carrier 1000 comprises first and second structures, 100 and 200, connected by straps, 204–210, wherein FIG. 1 generally illustrates a front view of the first structure 100, FIGS. 2 and 3 generally illustrate left and right side views of the first and second structures, 100 and 200, FIG. 4 generally illustrates a back view of the second structure 200, and FIG. 5 illustrates a typical employment of the infant carrier 1000.

Referring to FIG. 1, the first structure 100 includes a front pad 102 for bending around and securing the torso or back of an infant against a person wearing the infant carrier 1000, a substantially rigid seat structure 104 upon which the infant sits while being carried in the infant carrier 1000, and a center padded strap 106 connecting the front pad 102 to the seat structure 104, which the infant generally straddles while sitting on the seat structure 104.

The shape of the front pad 102 is generally rectangular with tapered ends having a length of approximately 17 inches, a width of approximately 4¼ inches at its center and 2 inches at its tapered ends, and a thickness of approximately ½ inch. The front pad 102 is flexible comprising soft padding material covered by a durable fabric such as nylon. Right and left front end straps, 108 and 112, respectively, are preferably sewn into the right and left inside ends (e.g., on the side facing the wearer) of the front pad 102, with right and left end clasps or buckles, 110 and 114, respectively, secured to top extending ends of the right and left front end straps, 108 and 112, respectively.

A chest strap 204 having a clasp 120 and hook 214 is inserted through a conventionally stitched area 116 of the front pad 102 such that it slides freely through the stitched area 116. For example, the chest strap 204 may be slid with the clasp 120 first through the stitched area 116 of the front pad 102 from the left side to the right side (as shown in FIG. 1) of the stitched area 116, or it may be slid from the right side to the left side (configuration not shown) of the stitched area 116.

The shape of the substantially rigid seat structure 104 is generally cylindrical with a length of approximately 12 inches and a diameter of approximately 5 inches. The seat structure 104 comprises a hollow cyclinder formed of a strong, but light weight material such as PVC pipe, and is thermally insulated and padded with material such as foam 132, and covered with a durable fabric such as nylon. Although shown as being rounded in the figures, the top of the seat structure 104 where an infant would sit, may also be flattened or otherwise contoured for additional infant comfort.

The seat structure 104 is multi-functional in that it preferably serves other functions besides being a seat. For example, a zipper 124 allows entry into an insulated cavity 134 of the seat structure for storing objects such as a baby bottle or jars of baby food, and into a storage pocket 126 formed below the seat structure 104 by a 2–4 inch extension of covering material, for storing other objects such as diapers, a wallet and/or keys.

A waist strap 206 having a hook 218 is secured to a left extension 128-2 of the covering material of the seat structure 104, and a corresponding clasp or buckle 130 is secured to a right extension 128-1 of the covering material (as shown in FIG. 1), to accomodate right-handed wearers. Alternatively, the waist strap 206 may be secured to the right extension 128-1 of the covering material of the seat structure 104, and the corresponding clasp or buckle secured to the left extension 128-2 of the covering material (configuration not shown), to accomodate left-handed wearers.

The shape of the padded center strap 106 is generally a trapezoid with a width of approximately 6 inches between parallel sides, wherein one parallel side having a length of approximately 5 inches is connected to the front pad 102, and the other parallel side having a length of approximately 2¾ inches is connected to the substantially rigid seat structure 104. The padded center strap 106 is also flexible comprising soft padding covered by a durable fabric such as nylon.

Referring now to FIGS. 2 and 3, left and right side views of the infant carrier 1000 are shown. As shown in the figures, the first structure 100 described with reference to FIG. 1 connects by corresponding buckles to the second structure 200 to be described with reference to FIG. 4. In its normal employment, the second structure 200 is positioned against the wearer, and the first structure 100 holding the infant is positioned away from the wearer. For example, the second structure 200 may be positioned against the chest of the wearer as a front mounted infant carrier, or the second structure 200 may be positioned against the back of the wearer as a back mounted infant carrier. In another employment, the infant carrier may be secured to a chair to function as a booster seat for the infant.

Referring now to FIG. 4, the second structure 200 includes a back pad 202 and two padded shoulder straps, 208 and 210, with distal ends extending away from the back pad 202. The shape of the back pad 202 is substantially a trapezoid with rounded edges to generally conform to the shape of an adult persons's back. As an example, a back pad having a width of approximately 12 inches between parallel top and bottom sides, wherein the top parallel side has a length of approximately 11½ inches and the bottom parallel side has a length of approximately 7½ inches, generally conforms to such requirement.

The chest and waist straps, 204 and 206, respectively, are inserted through conventionally stitched areas, 234 and 236, respectively, of the back pad 202 such that they freely slide through the stitched areas, 234 and 236, in a similar manner as the chest strap 204 was previously described as being inserted and slid through the stitched area 116 of the front pad 102. Additional stitched areas (not shown) may also be provided on the back pad 202 so that the pad can be worn higher or lower on the wearer by inserting the chest and waist straps, 204 and 206, respectively, into appropriate ones of the additional stitched areas of the back pad 202.

The chest strap 204 is approximately 1 inch in width with a length adjustable in a conventional fashion by loosening or tightening the strap into the hook 214 or clasp 120. The waist strap 206 is fully padded and wider than the chest strap 204 for comfort. For example, the width of the waist strap 204 may be in the range of 1½–3 inches. The length of the waist strap 206 is also adjustable in the conventional fashion by loosening or tightening the strap into the hook 218 or clasp 130. The hook 214 and the clasp 120 of the chest strap 204 are secured together in a conventional fashion by insertion of the hook 214 into the clasp 120. Likewise, the hook 218 and the clasp 130 of the waist strap 206 are secured together in a conventional fashion by insertion of the hook 218 into the clasp 218.

Right and left shoulder straps, 208 and 210, are stitched or otherwise securely fastened to the back pad 202 to approximately form a "V". Both shoulder straps, 208 and 210, are fully padded with width approximately the same as the waist strap 206. The lengths of the right and left shoulder straps, 208 and 210, are also adjustable in the conventional fashion by tightening or loosening their straps into their respective hooks, 230 and 234, or respective clasps, 110 and 114. For example, excess strapping 233 is shown extending from the hook 234 in FIG. 2 after tightening the left shoulder strap 210. The hooks and clasps of the right and left shoulder straps, 208 and 210, respectively, are secured in the conventional fashion by inserting their respective hook into their respective clasp.

Referring back to FIGS. 1–3 now, the first and second structures, 100 and 200, are shown being connected together by the waist strap hook 218 being inserted into and held by the waist strap clasp 130 (i.e., mating the hook with the clasp); by the chest strap hook 214 being inserted into and held by the chest strap clasp 120; and by right and left shoulder strap hooks, 230 and 234, being respectively inserted into and held by right and left front pad clasps, 110 and 114. To firmly secure the infant against the body of the wearer, the front pad 102 is shown to be bent in conformance with the shape of the infant's torso or back, and the center strap 106 slightly bent as in actual usage for the infant's comfort in FIG. 2.

FIG. 5 illustrates, as an example, a typical employment of the infant carrier 1000. In this employment, the infant sits on the seat structure 104 facing away from the wearer, who wears the infant carrier 1000 on her front. In this position, both the arms and legs of the infant are free to move, while the torso of the infant is securely held against the chest of the wearer by the front pad 102. Excess strapping, 229 and 233, are shown extending out of the respective hooks of the right and left shoulder straps, 208 and 210, after tightening of the shoulder straps as previously described. In other employments of the infant carrier 1000, the infant carrier 1000 could also be worn on the wearer's back as well as the wearer's front, and the infant could also be positioned facing towards the wearer as well as away from the wearer.

Although the various aspects of the present invention have been described with respect to a preferred embodiment, it will be understood that the invention is entitled to full protection within the full scope of the appended claims.

What is claimed is:

1. An infant carrier comprising:

means for securing the torso of an infant against a person wearing the infant carrier so as to leave the arms and legs of the infant free to move; and a substantially rigid seat having the shape of a right cylinder connected to said securing means so as to support the seat of the infant on an outer cylindrical surface of said seat structure.

2. The infant carrier as recited in claim 1, wherein said cylindrically shaped seat structure is padded and covered with fabric.

3. The infant carrier as recited in claim 2, wherein said cylindrically shaped seat structure has a cavity for storing objects, and means for opening and closing an access to said cavity through said fabric covering.

4. The infant carrier as recited in claim 3, wherein said cavity of said cylindrically shaped seat structure is thermally insulated from exterior surfaces of said cylindrically shaped seat structure.

5. An infant carrier comprising:

means for securing the torso of an infant against a person wearing the infant carrier so as to leave the arms and legs of the infant free to move; and a substantially rigid cylindrically shaped seat structure connected to said securing means, for supporting the seat of the infant, wherein said substantially rigid cylindrically shaped seat structure comprises a length of PVC pipe having a diameter between 3 to 7 inches.

6. An infant carrier comprising:

means for securing the torso of an infant against a person wearing the infant carrier so as to leave the arms and legs of the infant free to move; and a substantially rigid cylindrically shaped seat structure connected to said securing means, for supporting the seat of the infant, wherein said securing means includes a rectangularly shaped front pad connected to said substantially rigid cylindrically shaped seat structure, and a back pad structure connected by fasteners to said rectangularly shaped front pad and said substantially rigid cylindrically shaped seat structure, and said back pad structure includes two adjustable shoulder straps and an adjustable chest strap fastened to said rectangularly shaped front pad, and an adjustable waist strap fastened to said substantially rigid cylindrically shaped seat structure, so as to distribute the weight of the infant being carried between the shoulders, chest, and waist of the wearer of the infant carrier.

7. An infant carrier comprising:

a first structure including a front pad, a seat structure, and a center strap connecting said front pad to said seat structure, wherein said seat structure is substantially rigid and cylindrically shaped; and a second structure including a back pad having adjustable right and left shoulder straps, an adjustable chest strap, and an adjustable waist strap, wherein said adjustable right and left shoulder straps and said adjustable chest strap are connected by means for fastening said adjustable right and left shoulder straps and said adjustable chest strap to said front pad of said first structure, and said adjustable waist strap to said seat structure of said first structure, such that the weight of an infant being carried in the infant carrier is distributed between the shoulders, chest, and waist of a person wearing the infant carrier.

8. The infant carrier as recited in claim 7, wherein said seat structure is padded and covered with fabric.

9. The infant carrier as recited in claim 8, wherein said seat structure has a cavity for storing objects, and means for opening and closing an access to said cavity through said fabric covering.

10. The infant carrier as recited in claim 9, wherein said cavity of said seat structure is thermally insulated from exterior surfaces of said seat structure.

11. The infant carrier as recited in claim 7, wherein said seat structure comprises a length of PVC pipe having a diameter between 3 to 7 inches.

12. An infant carrier comprising:

a front pad;

a substantially rigid seat structure connected to said front pad;

a back pad having adjustable shoulder straps, an adjustable chest strap, and an adjustable waist strap; and means for fastening said adjustable shoulder straps and adjustable chest straps to said front pad, and said adjustable waist strap to said substantially rigid seat structure such that the weight of an infant sitting on said substantially rigid seat structure is comfortably distributed between the shoulders, chest, and waist of a person wearing the infant carrier.

13. The infant carrier as recited in claim 12, wherein said front pad secures the torso of the infant being carried against the person wearing the infant carrier in such a manner as to allow free movement of the arms and legs of the infant.

14. The infant carrier as recited in claim 12, wherein said substantially rigid seat structure is substantially rigid and cylindrically shaped.

15. The infant carrier as recited in claim 14, wherein said seat structure is padded and covered with fabric.

16. The infant carrier as recited in claim 15, wherein said seat structure has a cavity for storing objects, and means for opening and closing an access to said cavity through said fabric covering.

17. The infant carrier as recited in claim 16, wherein said cavity of said seat structure is thermally insulated from exterior surfaces of said seat structure.

18. The infant carrier as recited in claim 14, wherein said seat structure comprises a length of PVC pipe having a diameter between 3 to 7 inches.

* * * * *